US005782234A

United States Patent [19]

Bates

[11] Patent Number: 5,782,234

[45] Date of Patent: Jul. 21, 1998

[54] RESPIRATORY BREATHING FILTER APPARATUS AND METHOD

[76] Inventor: Charles W. Bates, 450 E. 126th St., Los Angeles, Calif. 90061

[21] Appl. No.: 417,372

[22] Filed: Apr. 5, 1995

[51] Int. Cl.[6] ..... A62B 7/10

[52] U.S. Cl. ..... 128/205.27; 128/205.28; 128/205.29; 128/204.13; 128/206.15; 128/206.29; 128/204.23

[58] Field of Search ..... 128/201.11, 203.23, 128/204.13, 205.27, 205.28, 205.29, 206.15, 206.29, 207.14, 204.23

[56] References Cited

U.S. PATENT DOCUMENTS

| | | | |
|---|---|---|---|
| 413,100 | 10/1889 | Smith | 128/203.23 |
| 589,712 | 9/1897 | Fouquier | 128/202.16 |
| 712,304 | 10/1902 | Jacobs et al. | 128/204.13 |
| 971,214 | 11/1910 | Montgomery | 128/203.23 |
| 1,134,993 | 4/1915 | Bye | 128/202.17 |
| 2,642,063 | 6/1953 | Brown | 128/203.15 |
| 3,027,897 | 4/1962 | Carofiglio | 128/203.23 |
| 3,774,601 | 11/1973 | Langone | 128/206.11 |
| 4,231,364 | 11/1980 | Speshyock | 128/207.14 |
| 4,262,666 | 4/1981 | Nelson | 128/203.23 |
| 4,478,215 | 10/1984 | Hanlon | 128/207.14 |
| 5,386,825 | 2/1995 | Bates | 128/205.27 |

*Primary Examiner*—Aaron J. Lewis

[57] ABSTRACT

An advanced and versatile method for a RESPIRATORY BREATHING FILTER APPARATUS having an outer body that conforms to the natural formation of the human mouth and is engaged by the teeth without the use of hands. Primarily designed for use by users with respiratory ailments, (i.e., asthma, cystic fibrosis, emphysema, allergies related to respiratory problems) the apparatus can be used by users engaged in aerobic activities with safety and fewer body restrictions. The apparatus has an outer body and six removable parts. The first of these parts is a removable outer or macro-particle filter for removal of coarse foreign airborne particles from an incoming airstream. The second of the two filters is separate from the outer filter and is positioned inside the outer body. This second filter is designed to remove smaller or micro-particles from the incoming airstreams. This second filter is removable, which is a tremendous advantage from previously presented methods and systems. This second filter has the capacity to accept a medicament. The medicament is evaporatively added to the incoming airstream and provides added relief to the user having respiratory tract ailments. Following the second filter, is a sterile screen with dual probes capable of sensing body temperature, detect artial blood gases and respiration. A removable retaining ring maintains the second filter and the sterile screen. The retaining ring also secures two one-way valves simultaneously when placed in position. The two one-way valves open during exhalation and close during inhalation. Method of use is also disclosed.

8 Claims, 2 Drawing Sheets

RESPIRATORY BREATHING FILTER APPARATUS AND METHOD

BACKGROUND OF INVENTION

1. Filed of the Invention

The RESPIRATORY BREATHING FILTER APPARATUS relates to filter devices worn in the mouth and provides versatile filtering capabilities due to the removal and/or addition of the component parts.

2. Brief Description of the Prior Art

Speshyock, U.S. Pat. No. 4,231,364 teaches a breathing device received with the mouth of the user which filters and enhances inhaled air by the addition of a medicament. Note the shield (32), and that the mouth is kept open (FIG. 1). Montgomery, U.S. Pat. No. 971,214 teaches that a respiratory filter can be worn on a chain around a user's neck when not needed (FIG. 5). U.S. Pat. No. 712,304 to Jacobs, et al., U.S. Pat. No. 3,774,601 to Langone, U.S. Pat. No. 4,662,666 to Nelson, and U.S. Pat. No. 4,478,215 to Hanlon, all teach of filters that are received within a user's mouth. U.S. Pat. No. 2,642,063 to Brown, teaches of a valved inhalation filter. U.S. Pat. No. 413,100 to Smith, U.S. Pat. No. 1,134,993 to Bye, U.S. Pat. No. 3,027,897 to Carofiglio, and U.S. Pat. No. 589,712 to Fouquier, all teach respiratory filters with medicament inhaling means. Bates U.S. Pat. No. 5,386,185 teaches of a breathing device received within the mouth with removeable filters, medicament screen, two one-way valves and safety retaining ring. The remaining references are all directed to mouth- or nose-inserted respiratory filters.

Respiratory Breathing filters have taken several forms, varying from gas masks with sophisticated filtering techniques by military and para-military personnel to filtering and breathing apparatus used by persons involved with occupations and activities in which harmful or contaminated gas or vapors were present, such as fumigation and painting occupations. The filtering devices used vary from a gauze or similar porous material to carbon or charcoal filtering to more sophisticated filtering, such as with nerve gases used in warfare. In each instance mentioned, the user's respiratory health condition was of average or good condition. The present Respiratory Breathing Filter Apparatus aids the individual as a preventative measure against the suffering of asthma attacks, emphysema, cystic fibrosis, and respiratory diseases related to allergies or polluted air. Respiratory disease is ranked the number six leading cause of death in the United States. With increased pollution and the re-emergence of tuberculosis, respiratory ailments are ever increasing. From 1979 to 1987, the number of deaths due to asthma has nearly doubled. The National Heart, Lung and Blood Institute determined that the reasons for the increased number of incidents of respiratory ailments are due to the lack of immediate access to a doctor or hospital for care, lack of education, and undertreatment.

It is a well-known fact that asthma can be triggered by cigarette smoke, air pollution, pollen, respiratory colds, chemicals, animal dander/hair, stress, cold or damp air, food additives, dairy products and even exercise. And in most cases the remedies involve a list of various drug treatments. With all the chemical inducements of various medications, the best-known remedy is home preventive therapy, doctors say. Dr. Albert Sheffer, clinical professor of medicine at Harvard Medical School and head of a federal panel advising doctors on how to treat asthma, said, "It's not whether you're an allergist or a pulmonary doctory. It's whether you take care of asthma. So it doesn't make any difference what the specialty is." Here the doctors indicates an emphasis on the care and prevention of asthma.

There are an estimated 12 million asthmatics in the United States alone, and of that number some 5 million are young people under the age of eighteen. Asthma is a growing problem and requires a controlled or preventive solution. This invention of the Respiratory Breathing Filter Apparatus addresses itself to these very issues of prevention which will make a measureable difference in the number of incidents of asthma and other respiratory problems. At present, there are very few inventions related to respiratory breathing filters for the prevention of respiratory problems.

OBJECTS OF THE INVENTION

It is, therefore, one of the primary object of the present invention to provide a respiratory breathing filter which is capable of removing both large-sized particles in an incoming airstream and for also removing smaller airborne particles and like particles from the airstream in order to clear the air for a user.

It is a further object of the present invention to provide a respiratory breathing filter of the type stated which utilizes a pair of spaced-apart filters. The forward filter is of a reusable porous material for removal of large airborne particles; and a second filter is for removal of smaller particles. This second filter may vary as to create more resistance to inspired and exhaled air flow rates to strengthen the lung and diaphragm functions.

It is another object of the present invention to provide a respiratory breathing filter of the type stated in which a prescribed medicament maybe applied to the incoming airstream. The medicament is administered into the second filter to aid the user with respiratory tract ailments. Other inducements may be administered to the second filter such as herbal or fruit-flavored enhancers. Another object of the present invention provides two orifices on the second filter that align with probe holes in the outer body and with probes on the sterile screen to secure the second filter in position.

It is another object of the present invention to provide a respiratory breathing filter of the type stated in which a sterile screen is specially designed and capable of being used in conjunction with existing monitoring devices to conduct artial gas analysis, body temperature and respiratory measurements. Another object of the sterile screen provides dual probes that extends through the second filter and outer body providing a safety measure for securing these internal parts and preventing any destroyed or broken parts from entering or obstructing the airway of the user.

It is another object to provide two one-way valves to increase the exhaled air flow. There are two removable one-way valves which will allow exhaled air to exit and prevent increased carbon dioxide levels. During inhalation the two one-way valves are closed and directs the air flow through the second filter in the interior of the apparatus.

It is another object to provide a retaining ring. The retaining ring holds the second filter, the sterile screen with dual probes and the two one-way valves in a secured position during use. This retaining ring is removable. This is another safety measure employed by the device.

It is another object of the present invention to provide a respiratory breathing filter which offers a mouthpiece as part of its outer body shape and size to conform to the natural contours of the human mouth.

It is an object of the present invention to offer a versatile design which enables the user to increase air intake or flow by removing, altering or changing interior parts. The user will have the option to increase air flow on clear days, increase air filtration on smoggy days, and/or provide medicament to an already cleaned air flow.

It is further the object of the present invention to provide a shield for the teeth of the user by offering a cradle that surrounds the user's teeth similar to a boxer's or football player's mouthpiece.

It is another object of the present invention to provide a method or means of varying the air flow as an attempt to exercise the lungs of the user and to enhance deep breathing.

It is further the object to provide a means of moisturization of environmentally dry air (i.e. desert air). The outer removable filter that extends across the front of the outer body can be used as a simple air conditioner by applying a small amount of liquid (i.e., water, juices or the like) to the filter, which will cool and moisten already dry airstream.

With the above and other objects in view, my invention resides in the novel features of form, construction, arrangement and combination of parts presently described and pointed out in the claims.

BRIEF SUMMARY OF THE INVENTION

The Respiratory Breathing Filter Apparatus is adapted to be engaged by the lips and teeth of a user in order to enable inhalations of air through the mouth of the user, then through the filters and into the lungs. During exhalation, said apparatus increases air flow and reduces carbon dioxide retention by the use of two one-way valves. The Respiratory Breathing Filter Apparatus is highly effective for use by people without respiratory ailments and who engage in aerobic activities, such as sport activities, walking, dancing and the like, to breathe cleaner air. The Respiratory Breathing Filter Apparatus is highly effective for use by individuals suffering from respiratory tract disease since the apparatus is designed to cleanse the air and, moreover, to apply a medicament to the incoming airstream for application to the respiratory tract of the user.

The Respiratory Breathing Filter Apparatus is comprised of an arcuate outer body in a shape similar to a slice of an orange. The apparatus is comprised of an outer or first filter made of reusable porous material designed to remove coarse particles which may be entrained in an incoming airstream. An interior or second filter, separate from the first filter, is located within the outer body for removing any smaller particles, such as unwanted smog particulates, smoke and other small airborne particles which are entrained in the incoming airstream.

The housing of the Respiratory Breathing Filter Apparatus of the present invention may be constructed of an approved durable plastic. The housing and component parts provide for probes that extend through the device and can be used for supporting a neck strap or like retaining device to allow the apparatus to be suspended from the neck of the user while not in use. Due to the size and shape of the invention, it is not readily visible, which could preclude any unnecessary annoying poking-of-fun by other children. There are other advantages to this invention which may be more clearly apparent from a consideration of design or form in which it may be embodied. While the invention has been described in general terms, the above description will set forth at least one specific form in which the invention may be embodied. However, it is to be understood that the following detailed description only set forth one preferred embodiment of the present invention and is therefore not to be taken in a limiting sense.

The apparatus provides versatility by allowing the user to include all or exclude some or all of the interior component parts. This procedure would vary the flow and/or filtration method. As an example, a hiker may desire the mountain air but would like to remove the dirt and pollen from the inhaled air. By removing the valve and/or second filter, the user can increase incoming air flow and/or decrease filtering of said incoming air.

BRIEF DESCRIPTION OF THE DRAWINGS

Figure 2:
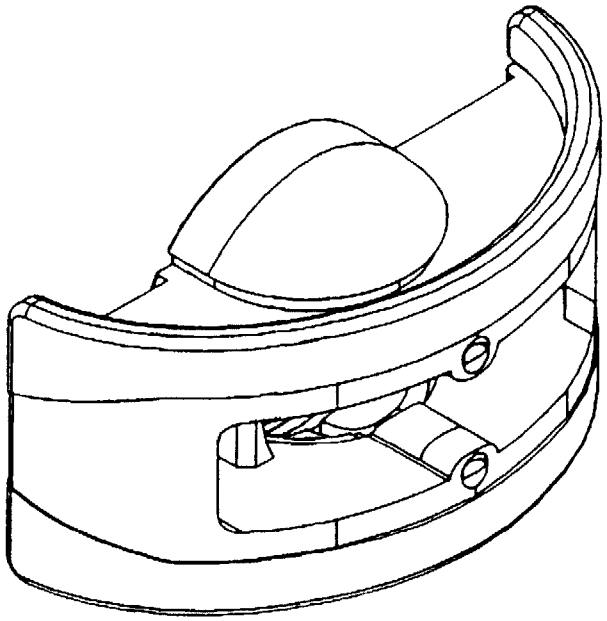
Figure 1:
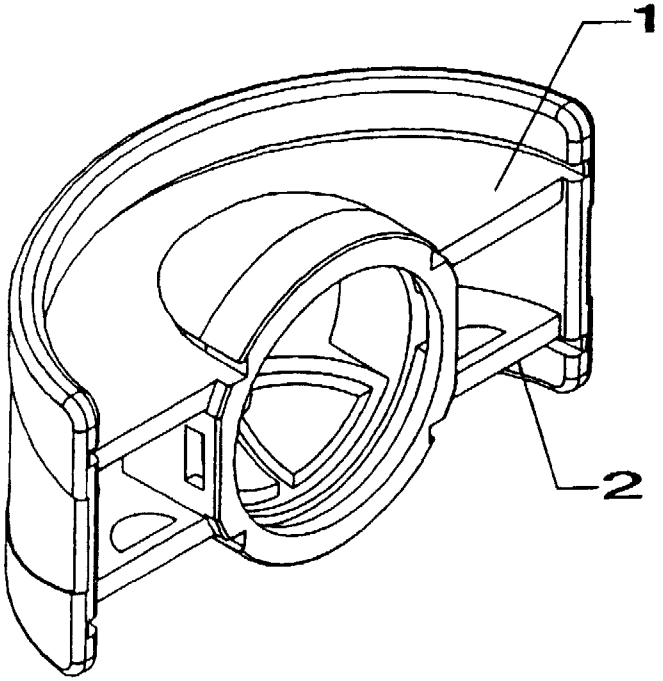
Figure 3:
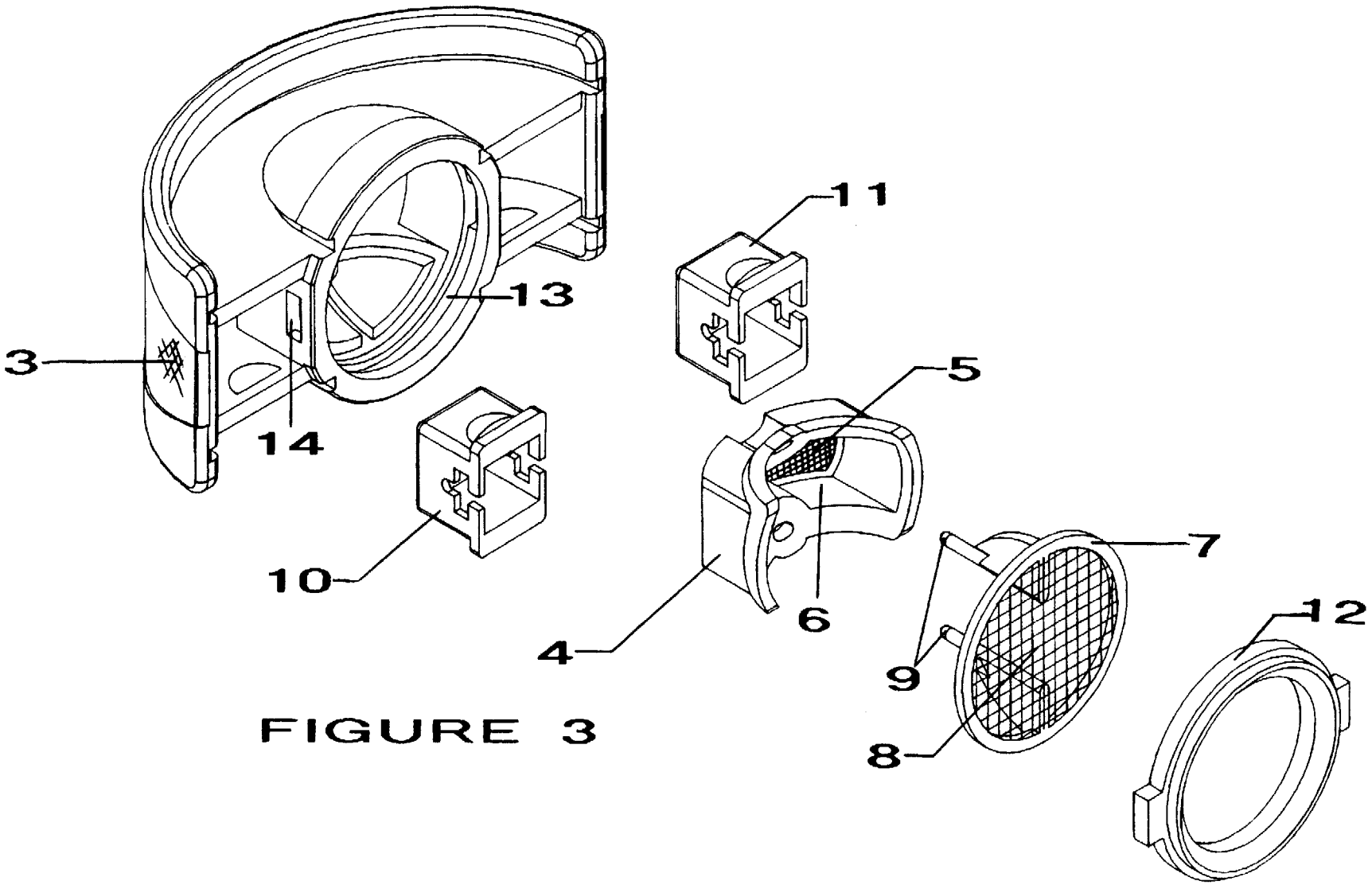

Having thus described in general terms, reference will now be made to the accompanying drawings in which:

FIG. 1 is a rear view of the Respiratory Breathing Filter Apparatus outer body;

FIG. 2 is the frontal view of the Respiratory Breathing Filter Apparatus of FIG. 1;

FIG. 3 is an exploded view of the Respiratory Breathing Filter Apparatus of FIG. 1.

DETAILED DESCRIPTION OF A PREFERRED EMBODIMENT

In the embodiment of the apparatus, as illustrated in FIGS. 1 and 2, there is provided an outer body or housing, which is somewhat arcuate in shape or an "orange-slice" shape or similar to a athletic mouthpiece. The outer body is to be engaged by the lips and teeth of the user.

By reference to FIGS. 1 and 2, it can be observed that the outer body or housing is arcuately shaped and the center portion of the outer body is bell or dome shaped and is located behind the teeth of the user inward in the mouth, thus conforming more to the natural contours of the user's mouth.

The apparatus is somewhat in the manner of a protective mouthpiece used by boxers and football players. The apparatus cradles the teeth of the user to provide an opening for the teeth of the user to hold the device in position during use. The purpose of this device is to filter the inhaled air, not to protect the teeth of the user.

The outer body or housing of FIGS. 1 and 2 has upper and lower walls, which provide recesses 1 and 2, and allows upper and lower rows of teeth to be placed, respectively. In this way, the user can bite down on the outer body or housing and retentively hold the apparatus in position without use of hands. The outer body or housing may be formed of a suitable semi-hard approved plastic or similar material.

The first filter or outer filter 3 extends across the forward arcuate end of the outer body or housing. This filter may be referred to as a macro-particle filter and will remove unwanted large foreign airborne particles from an incoming airstream. This first filter 3 could be of a removable cloth or fine screen mesh material or the like that can be washed out and reused or removed and replaced with a new macro-particle filter.

In FIG. 3, the second filter 4 is spaced apart from the first filter and is located in the interior of the outer body and is removable and is inserted rearwardly of the outer body. The second filter 4 has a specific shape that allows intricate and concise matching within the cavity of the outer body.

Therefore, said second filter is located inside the user's mouth behind the teeth. The second filter consists of a permeable plastic mesh 5 in the front of the apparatus, but rearwardly of the first filter 3. Inside the second filter is an internal area 6 to be filled with filtering material such as activated carbon or other filtering material or both to vary flow rate and filtration. Internal area 6 also provides for the location of the medicament media. The medicament media is a absorbing material like a sponge or gauze material that will allow medication to be added to the incoming air stream for those suffering from respiratory ailments. A permeable sterile screen backing 8 retentively holds all contents in the internal area 6 of said second filter. This second filter 4 may be referred to as a micro-particle filter. This filter can be constructed to offer resistance to the incoming airstream flow as a desired effect to improve and strengthen the condition of the lungs and diaphragm. The users need along with medical advisor will determine the final construction of the second filter.

Rearward of the second filter is the permeable sterile screen backing 8 or so-called "screen" and which is surrounded by a mounting circular retainer ring 7, as shown in FIG. 3. This sterile screen may be made of tungsten mesh or other sensing media. Dual probes 9 provide continuity from the tungsten mesh or sensing media 8 through the outer body and monitor gas analysis, body temperature and respiration. The dual probes 9 provide for monitoring gas analysis, body temperature and respiration and operate in conjunction with the sterile screen 8 which functions as the sensing media. The dual probes and the outer edge of of sensing media are covered with semi-hard plastic.

Two one-way valves, 10 and 11, are adjacent to the open internal cavity and positioned between the biting surface of the teeth. During inhalation these one-way valves are in the closed position and direct the inhaled airstream through the second filter 4. During exhalation, these same one-way valves open to permit the elimination of exhaled air, carbon dioxide and moisture. These two one-way valves are inserted prior to the retaining ring, discussed next.

A specially designed retaining ring 12 secures the second filter 4, and the sterile screen 7 in place, preventing any movement of these internal parts. The retaining ring also secures the two one-way valves. The retaining ring fits into a recessed groove 13 and cut-outs 14. The retaining ring provides one of two methods to safely secure all component parts. The retaining ring is the final component part for insertion.

The embodiment of the apparatus is unique in that it offers options to air flow and filtration, such as exchange or removal of component parts. Additionally, an optional prescribed medicament can be used in conjunction with the second filter.

It should be understood that many changes, modifications, variations and other uses and applications will be apparent to those skilled in the art after considering this specification and the accompanying drawings. Therefore, any and all such changes, modification, variations and other uses and applications which do not depart from the spirit and scope of the invention are deemed to be covered by the invention, which is limited only by the following claims.

Having thus described the invention, what I desire to claim and secure by Letter Patent is:

1. A respiratory filter apparatus comprising:

a) an arcuate outer body sized and shaped to be received within a user's mouth, said arcuate outer body having upper and lower recesses to receive a user's teeth for removably holding the body within a user's mouth;

b) first filter means for removing large particles from an inhaled airstream, said first filter means comprising a removable mesh-like material extending across a forward end of said arcuate body in proximity to the upper and lower recesses, and a second filter means for also removing material from an inhaled airstream and having means for holding an evaporative medicament within said second filter means and to allow a medicament to be added to an inhaled airstream;

c) valve means for dispensing an exhaled airstream containing exhaled carbon dioxide and thereby preventing increased carbon dioxide levels within said filter apparatus, said valve means having a first position during exhalation wherein said valve means is open, and a second position during inhalation where said valve means is closed;

d) means for monitoring a user's body temperature and respired gases passing through said respiratory filter apparatus for gas analysis, said means for monitoring comprising a plurality of probes;

e) a sensing screen located in proximity to said plurality of probes and operating in conjunction therewith to sense characteristics of an exhaled airstream to enable a gas analysis and a monitoring of a user's body temperature with said respiratory filter apparatus.

2. The respiratory filter apparatus of claim 1 further characterized in that said first filter means comprises a removable mesh-like material extending across a forward end of the body.

3. The respiratory filter apparatus of claim 1 further characterized in that the means for monitoring also monitors for respiration.

4. The respiratory filter apparatus of claim 3 further characterized in that the means for monitoring comprises a retaining ring for holding said sensing screen and which retaining ring fits within a groove on said arcuate body.

5. The respiratory filter apparatus of claim 4 further characterized in that said valve means are check valve means permitting flow in one direction but not in an opposite direction.

6. The respiratory filter apparatus of claim 5 further characterized in that said retaining ring also secures said valve means in position within the body.

7. The respiratory filter apparatus of claim 3 further characterized in that said first and second filter means can be adjusted to vary air flow characteristics of an inhaled airstream.

8. The respiratory filter apparatus of claim 1 further characterized in that said second filter means can be provided with a source of moisture for moistening inhaled air and thereby cooling same.

* * * * *